US009687101B2

(12) United States Patent
Reetz et al.

(10) Patent No.: US 9,687,101 B2
(45) Date of Patent: Jun. 27, 2017

(54) ADJUSTABLE TREE COLLAR

(71) Applicant: Target Brands, Inc., Minneapolis, MN (US)

(72) Inventors: Paul D. Reetz, Minneapolis, MN (US); Laura E. Ramthun, Farmington, MN (US)

(73) Assignee: Target Brands, Inc., Minneapolis, MN (US)

( * ) Notice: Subject to any disclaimer, the term of this patent is extended or adjusted under 35 U.S.C. 154(b) by 250 days.

(21) Appl. No.: 14/505,019

(22) Filed: Oct. 2, 2014

(65) Prior Publication Data

US 2016/0095459 A1 Apr. 7, 2016

(51) Int. Cl.

| | |
|---|---|
| ***A47G 33/04*** | (2006.01) |
| *A47G 33/08* | (2006.01) |
| *A47G 33/12* | (2006.01) |

(52) U.S. Cl.

CPC ..... *A47G 33/04* (2013.01); *A47G 33/08* (2013.01); *A47G 33/12* (2013.01)

(58) Field of Classification Search

CPC ..... A47G 33/04; A47G 33/045; A47G 33/06; A47G 33/08; A47G 33/12; A47G 2033/1233; A47G 2033/1266; A47G 2033/128; A47G 2033/1286; A47G 2033/1293; A01G 13/0243; A01G 13/0281; A01G 13/043; A44C 5/2071; A44C 5/2076; Y10T 24/15; Y10T 24/152; Y10T 24/153; Y10T 24/155; Y10T 24/157; Y10T 24/158; Y10T 24/148; Y10T 24/44778; Y10T 24/44855; Y10T 24/44906; Y10T 24/44923; Y10T 24/47

See application file for complete search history.

(56) References Cited

U.S. PATENT DOCUMENTS

| | | | |
|---|---|---|---|
| 1,200,920 | A | 10/1916 | Boughton |
| 1,674,118 | A | 6/1928 | Merrick |
| 3,872,906 | A | 3/1975 | Bolanz |
| D386,114 | S | 11/1997 | Carson |

(Continued)

FOREIGN PATENT DOCUMENTS

| | | | |
|---|---|---|---|
| CA | 2833328 | A1 | 5/2014 |
| DE | 3937830 | A1 | 5/1991 |
| SE | 462074 | B * | 5/1990 |

OTHER PUBLICATIONS

Derwent Abstract for SE 462074 B (1990).*

(Continued)

*Primary Examiner* — Mark Ruthkosky
*Assistant Examiner* — Julia L Rummel
(74) *Attorney, Agent, or Firm* — Leanne Taveggia Farrell; Westman, Champlin & Koehler, P.A.

(57) ABSTRACT

A tree collar includes a sleeve formed into a frusto-conical shape and having an inner facing surface, an outer facing surface, a top edge, a bottom edge, a first end and a second end. The first and second ends overlap each other to adjust a diameter of the sleeve and a length of the band at the top edge is less than a length of the band at the bottom edge. A first clasp secures a portion of the top edge of the sleeve to a different portion of the top edge of the sleeve. A second clasp secures a portion of the bottom edge of the sleeve to a different portion of the bottom edge of the sleeve.

3 Claims, 13 Drawing Sheets

(56) References Cited

U.S. PATENT DOCUMENTS

2006/0217648 A1* 9/2006 Rogachevsky ..... A61F 5/055
602/20
2014/0298627 A1* 10/2014 Shields ..... A44B 18/003
24/449

OTHER PUBLICATIONS

English language translation of DE3937830, generated on Oct. 25, 2017 with Espacenet.com.*
Dandee, "DIY Galvanized Tree Collar", 2013, p. 1-4; http://www.dandeedesigns.com/2013/12/diygalvanizedtreecollar.html.*
In My Own Style, "Metal Christmas Tree Skirt," http://inmyownstyle.com/2012/11/metal-christmas-tree-skirt.html, at least as early as Jul. 2014, 1 page.
Taryn Cox The Wife, "Christmas Tree Basket Stand," http://www.taryncoxthewife.com/christmas-tree-basket-skirt/, at least as early as Jul. 2014, 1 page.
Dandee Designs, "DIY Galvanized Tree Collar," http://www.dandee-designs.com/2013/12/diy-galvanized-tree-collar.html, at least as early as Jul. 2014, 1 page.
Smart Solutions for Busy People, "Tree Trimming," http://smartsolutionsforbusypeople.com/blog/2013/10/30/one-stop-holiday-shopping-at-the-tree-lot/, at least as early as Jul. 2014, 1 page.
"How to Make a Conical (Zeleny) Baffle," Sialis, retrieved from <URL:http://www.sialis.org/conical.htm>, Oct. 10, 2007 (4 pages).
Office Action from Canadian Patent Application No. 2,877,630, mailed Apr. 2, 2015 (5 pages).

* cited by examiner

ADJUSTABLE TREE COLLAR

BACKGROUND

Freshly cut trees are brought into homes across the world in celebration of Christmas-related holidays. Each tree is supported by a tree stand so that the tree can be put on display in an upright fashion. Tree skirts are pieces of fabric that extend around the base of the trunk of the tree and are used to cover the stand.

The discussion above is merely provided for general background information and is not intended to be used as an aid in determining the scope of the claimed subject matter.

SUMMARY

A tree collar includes a band formed into a shape and having an interior surface, an exterior surface, a top edge, a bottom edge, a first end and a second end. The first and second ends overlap each other to provide an adjustable circumference to the shape of the band. A first hook attaches a portion of the top edge adjacent the second end of the band to a different portion of the top edge of the band. A second hook attaches a portion of the bottom edge adjacent the second end of the band to a different portion of the bottom edge of the band. A prong protrudes from the exterior surface of the band at a location that is spaced apart from the top edge and the bottom edge and spaced apart from the first end and the second end. A belt has a fixed end coupled to the exterior surface of the band, a free end and a plurality of holes located between the fixed end and the free end so that the prong can be inserted through one of the plurality of holes in the belt to secure the shape of the band at a set circumference.

A tree collar includes a sleeve formed into a frusto-conical shape and having an inner facing surface, an outer facing surface, a top edge, a bottom edge, a first end and a second end. The first and second ends overlap each other to adjust a diameter of the sleeve and a length of the band at the top edge is less than a length of the band at the bottom edge. A first clasp secures a portion of the top edge of the sleeve to a different portion of the top edge of the sleeve. A second clasp secures a portion of the bottom edge of the sleeve to a different portion of the bottom edge of the sleeve.

A method of hiding a tree stand including forming a band into a shape to surround the tree stand by overlapping first and second ends of the band. The band has an interior surface, an exterior surface, a top edge and a bottom edge. A portion of the top edge of the band is attached to a different portion of the top edge of the band with a first hook and a portion of the bottom edge of the band is attached to a different portion of the bottom edge of the band. The shape of the band is adjusted to a chosen circumference. The shape of the band is secured in the chosen circumference by inserting a prong that protrudes from the exterior surface of the band into one of a plurality of holes in a belt. The belt has a fixed end coupled to the exterior surface of the band and a free end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

The embodiments of tree collars described in detail below are capable of hiding tree stands that support trees in an upright orientation. In addition, the tree collar allows a tree stand that has a reservoir for containing water to be filled through the top of the tree collar without having to remove the tree collar from around the tree stand. Each tree collar is annular in shape and is made of a rigid, incompressible material. Further, each tree collar is adjustable to accommodate various sizes of tree stands by including ends that overlap each other and are movable relative to each other to adjust a diameter of the collar. The collar tapers from a top edge to a bottom edge so that a length of the collar at the top edge is less than a length and a diameter of the band or sleeve at a bottom edge. A first clasp secures a portion of the top edge of the sleeve to a different portion of the top edge of the sleeve. A second clasp secures a portion of the bottom edge of the sleeve to a different portion of the bottom edge of the sleeve.

Figure 1:
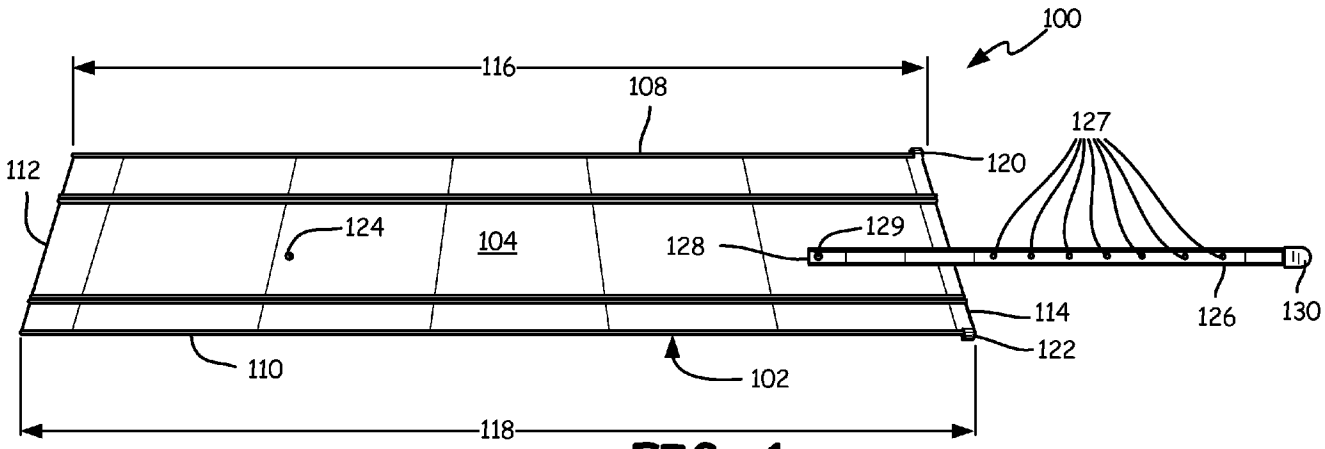
FIG. 1 is a plan view of an exterior of a tree collar in an unassembled state according to one embodiment.
Figure 2:
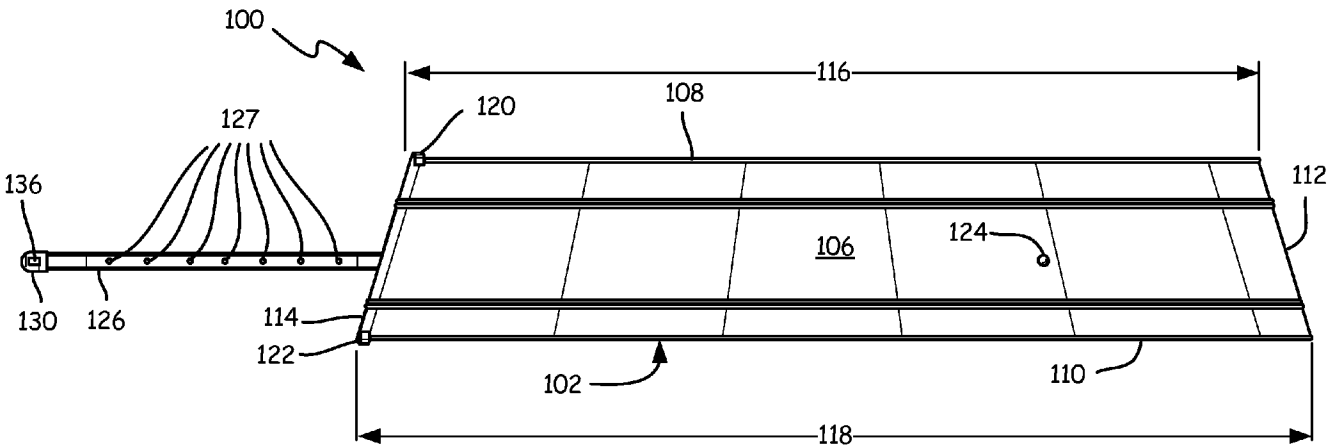
FIG. 2 is a plan view of an interior of the unassembled tree collar in FIG. 1.

FIG. 1 is a plan view of an exterior of a tree collar 100 in an unassembled state according to one embodiment. FIG. 2 is a plan view of an interior of tree collar 100 in the unassembled state. Tree collar 100 includes a band or sleeve 102. In the embodiment illustrated in FIGS. 1 and 2, band or sleeve 102 is made of a metal or ferromagnetic material, such as steel or other metal alloy containing nickel or cobalt, and has an exterior or outer facing surface 104 and an interior or inner facing surface 106. Band or sleeve 102 also includes a top edge 108, a bottom edge 110, a first end 112 and a second end 114. Band or sleeve 102 tapers from top edge 108 to bottom edge 110 so that a length 116 of top edge 108 is less than a length 118 of bottom edge 110.

Tree collar 100 further includes a first hook or clasp 120 and a second hook or clasp 122. First hook 120 is formed integrally with top edge 108 of band or sleeve 102 and second hook 122 is formed integrally with bottom edge 110 of band or sleeve 102. In the embodiment illustrated in FIGS. 1 and 2, first and second hooks 120 and 122 are located at second end 114 of band or sleeve 102. However, it should be realized that in other embodiments first and second hooks 120 and 122 can be located at first end 112 of band or sleeve 102 or at other locations along top edge 108 and bottom edge 110.

Tree collar 100 further includes a prong 124 that protrudes outwardly from exterior surface 104 at a location that is spaced apart from top edge 108, bottom edge 110 and first and second ends 112 and 114. In the embodiment illustrated in FIGS. 1 and 2, prong 124 extends through a thickness of band or sleeve 102 so as to also protrude both outwardly from exterior surface 104 and inwardly from interior surface 106 of band or sleeve 102. By extending through and protruding on both sides of band or sleeve 102, prong 124 has a greater structural integrity than just a small nub that protrudes outwardly from exterior surface 104 and as a result can withstand greater lateral forces.

Tree collar 100 further includes a belt 126. Belt 126 can be made of leather or other similar material, such as man made materials like a polysynthetic leather. Belt 126 includes a fixed end 128 and a free end 130. Fixed end 128 is coupled to exterior surface 104 of band or sleeve 102 by, for example, a rivet 129. Belt 126 includes a plurality of spaced apart holes 132 that are in linear alignment with each other, are spaced apart from fixed end 128 and free end 130 and are located between fixed end 128 and free end 130. As illustrated, fixed end 128 is located in closer proximity to second end 114 of band or sleeve 102 than first end 112 of band or sleeve 102. However, it should be realized that in other embodiments fixed end 128 of belt 126 can be located in closer proximity to first end 112 of band or sleeve 102 than second end 114 of band or sleeve 102.

Figure 3:
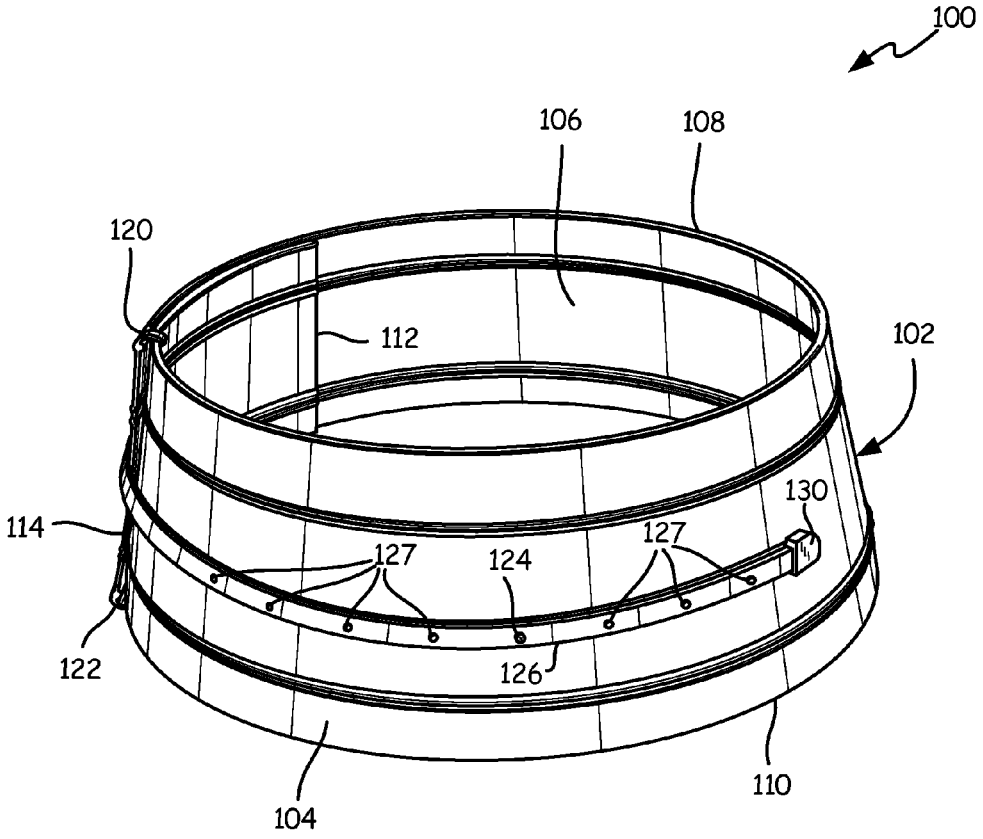
FIG. 3 is a perspective view of the tree collar of FIG. 1 in an assembled state according to another embodiment.
Figure 4:
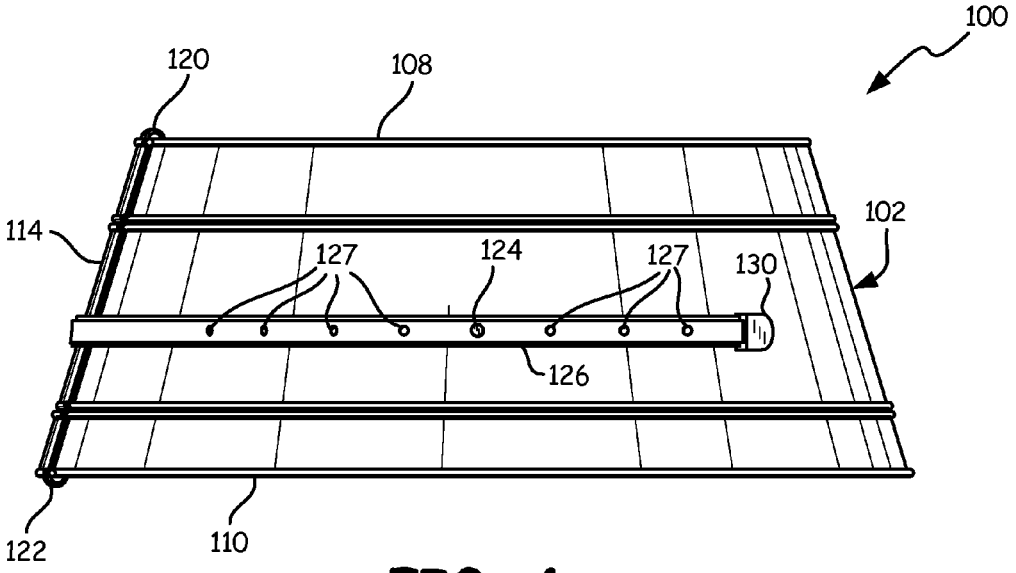
FIG. 4 is a front view of the assembled tree collar in FIG. 3.
Figure 5:
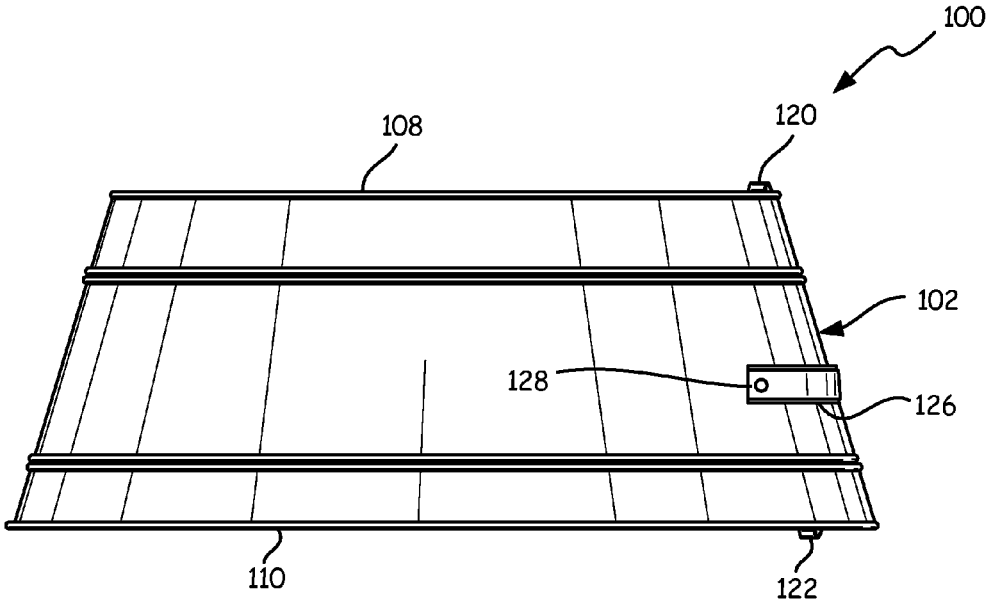
FIG. 5 is a back view of the assembled tree collar in FIG. 3.
Figure 6:
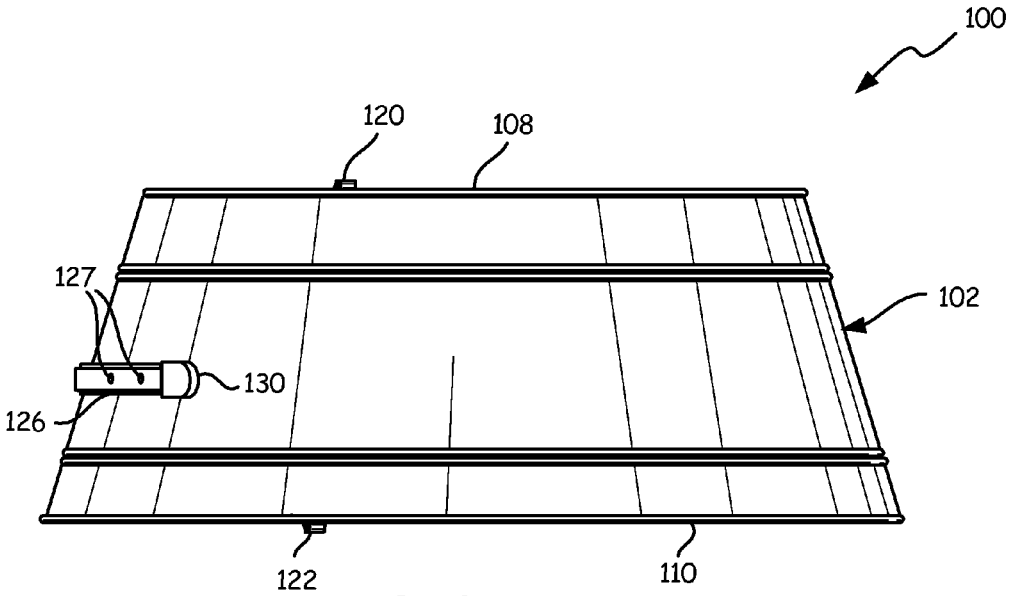
FIG. 6 is right side view of the assembled tree collar in FIG. 3.
Figure 7:
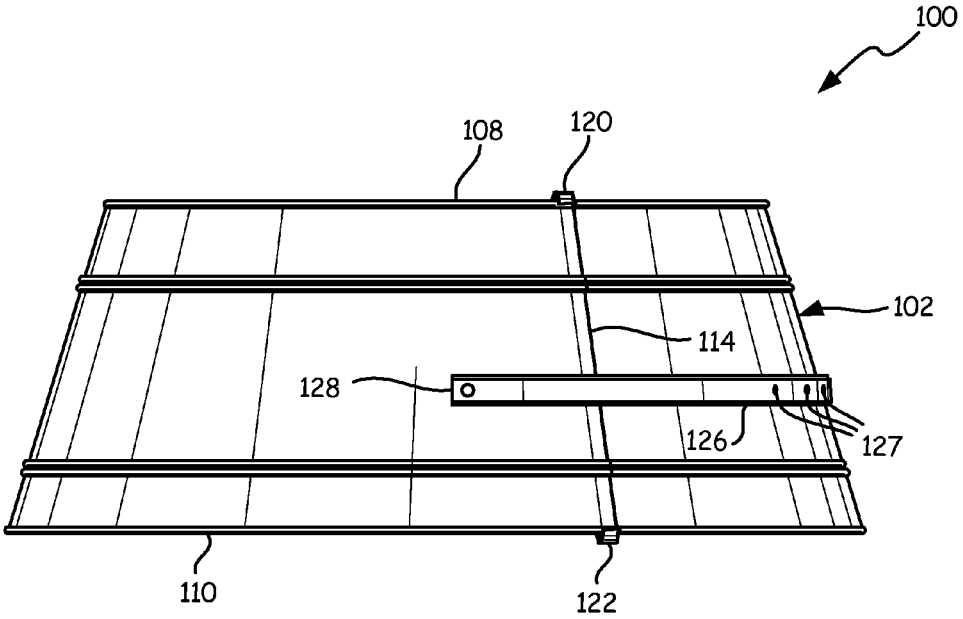
FIG. 7 is a left side view of the assembled tree collar in FIG. 3.
Figure 8:
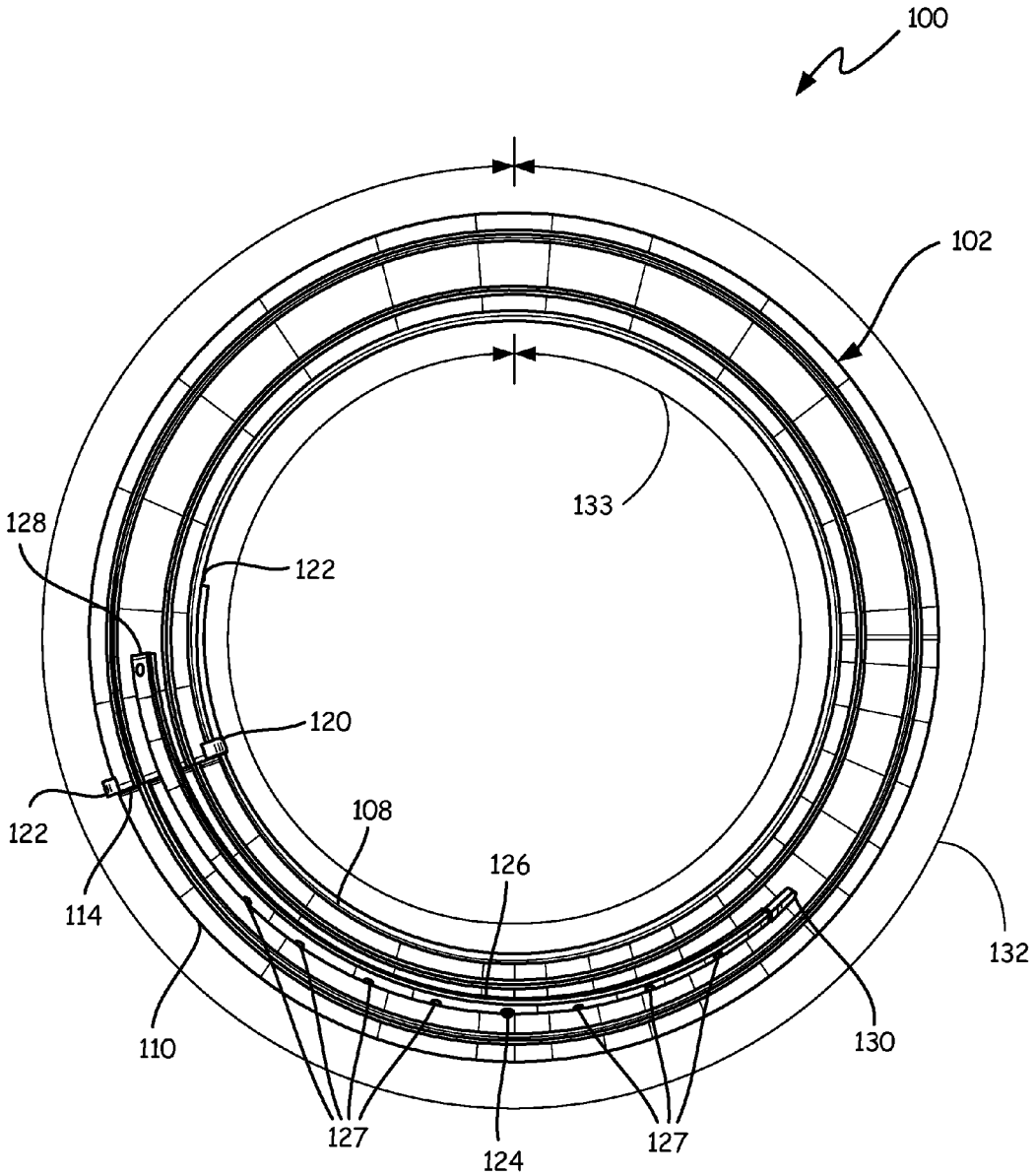
FIG. 8 is a top view of the assembled tree collar in FIG. 3.
Figure 9:
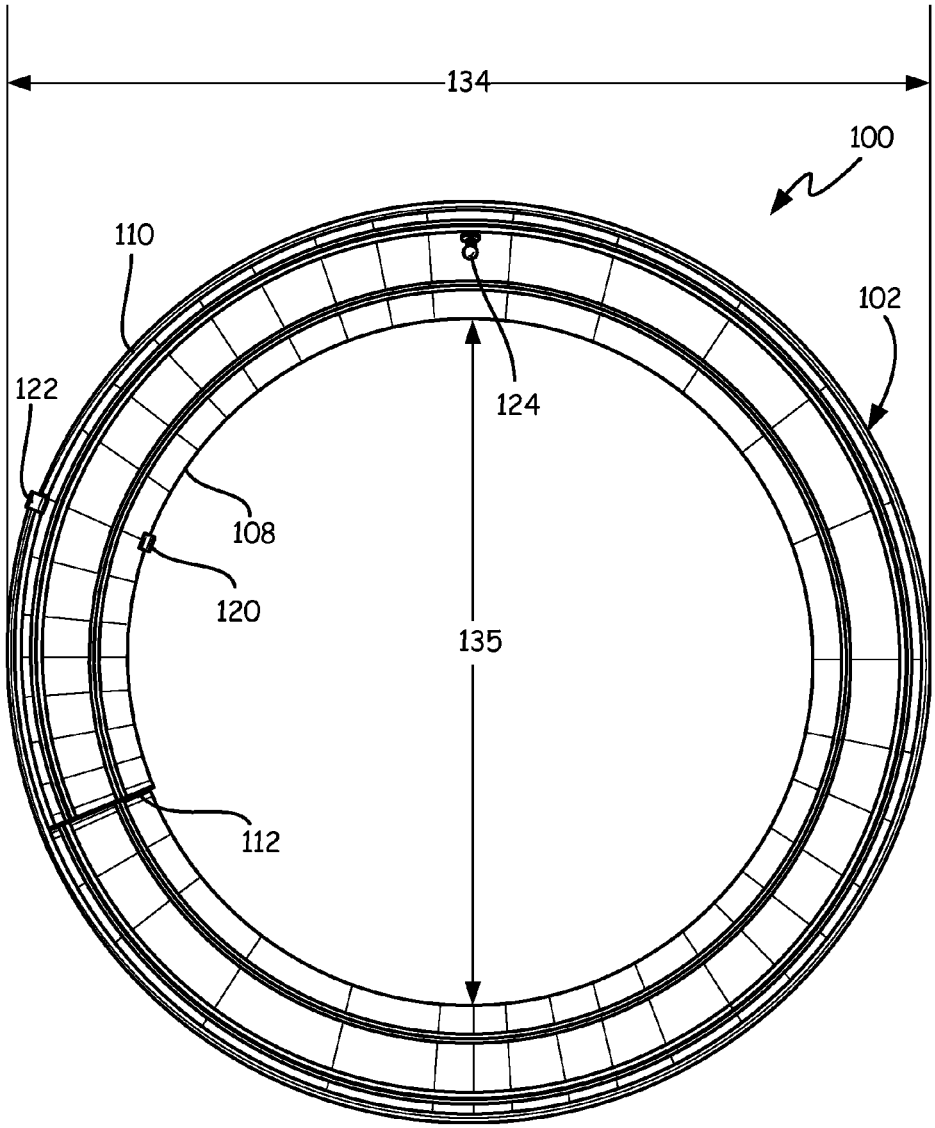
FIG. 9 is a bottom view of the assembled tree collar in FIG. 3.

FIG. 3 illustrates a perspective view of tree collar 100 in an assembled state. FIGS. 4-9 are orthogonal views of the assembled state of tree collar 100 in FIG. 3 including a front view, a back view, a right side view, a left side view, a top view and a bottom view, respectively. As assembled, tree collar 100 is annular and is formed into a frusto-conical shape so as to surround and a hide a tree stand. First and second ends 112 and 114 overlap each other to provide an adjustable circumference 132 along bottom edge 110 and an adjustable circumference 133 along top edge 108 of band or sleeve 102. Overlapping ends 112 and 114 also provide an adjustable diameter 134 at bottom edge 110 and an adjustable diameter 135 at top edge 108 of band or sleeve 102. Because band or sleeve 102 tapers from top edge 108 to bottom edge 110, adjustable circumference 132 around the bottom edge 110 of band or sleeve 102 is always greater than adjustable circumference 133 around the top edge 108 of band or sleeve 102. In addition, adjustable diameter 134 as measured through the center of the circle from bottom edge 110 to bottom edge 110 is always greater than adjustable diameter 135 as measured through the center of the circle from top edge 108 to top edge 108.

As illustrated in FIGS. 3-9, first end 112 is positioned so as to ride on the interior surface 106 of band or sleeve 102 while second end 114 is positioned so as to ride on exterior surface 104 of band or sleeve 102. In other words, exterior surface 104 of band 102 at first end 112 is placed adjacent to interior surface 106 of band 102 at second end 114 to form the frusto-conical shape. However, it should be realized that in the alternative, first end 112 could be positioned so as to ride on exterior surface 104 and second end 114 could be positioned so as to ride on interior surface 106 as long as first and second hooks 120 and 122 were arranged to either be integrally located on the first end 112 or first and second hooks 120 and 122 were formed integrally on second end 114, but extending outward instead of inward as illustrated in FIGS. 1-9.

Figure 10:
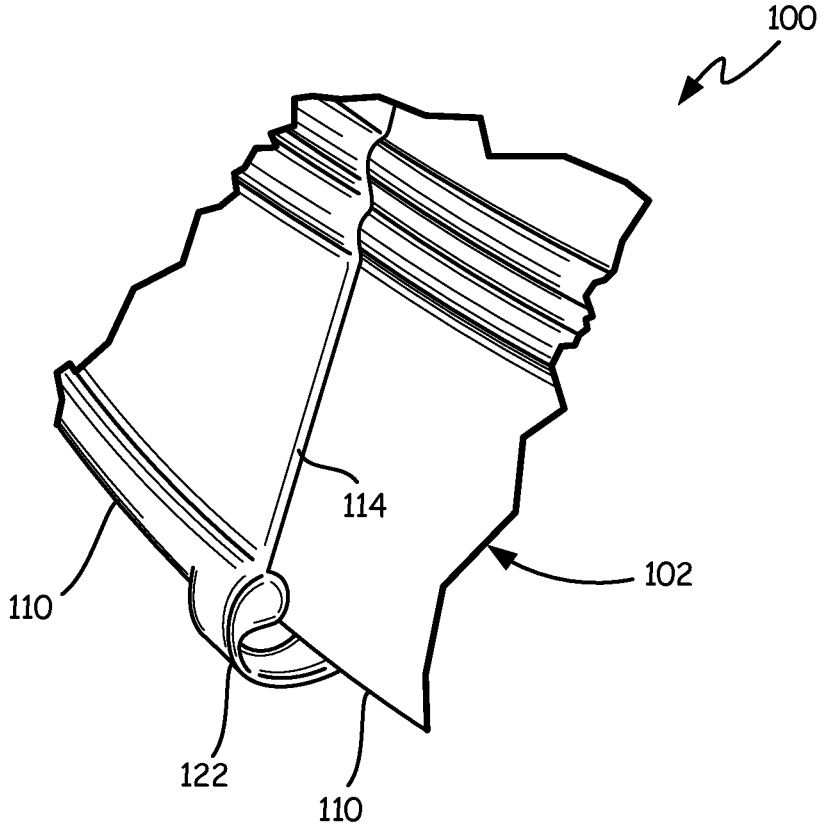
FIG. 10 is an enlarged perspective view of a second hook or clasp that attaches a portion of the bottom edge of the band or sleeve to a different portion of the bottom edge of the band or sleeve.

As illustrated in FIGS. 3-9 and when tree collar 100 is in the assembled state, first hook 120 attaches or secures a portion of top edge 108 of band 102 to a different portion of top edge 108 of band 102. As illustrated, one of those portions is adjacent to second end 114. Second hook 122 attaches or secures a portion of bottom edge 110 of band 102 to a different portion of bottom edge 110 of band 102. As illustrated, one of those portions is adjacent to second end 114. More specifically, first end 112 is inserted into first hook or clasp 120 and second hook or clasp 122, which are located on second end 114, so that the formed frusto-conical shape can be slidably adjusted to a chosen circumference or a chosen diameter of band 102. FIG. 10 illustrates an enlarged perspective view of second hook or clasp 122 of tree collar 100 that attaches or secures a portion of bottom edge 110 to a different portion of bottom edge 110.

After a circumference or diameter is selected that will properly hide and surround a tree stand, band 102 is secured in this position by inserting prong 124 into one of the plurality of holes 132 in belt 126. As shown in the embodiment illustrated in FIGS. 1-9, belt 126 includes eight spaced apart holes 127. This means that belt 126 can hold band 102 in eight different adjustable circumferences and eight different adjustable diameters. However, it should be realized that belt 126 can include any number of holes 127 including less than or greater than eight. In the embodiment illustrated in FIG. 1, prong 124 is inserted into the fifth hole 127 from fixed end 128.

As illustrated in FIG. 2, free end 130 of belt 126 includes a permanent magnetic 136. Permanent magnet 136 couples free end 130 of belt 126 to exterior surface 104 of band or sleeve 102 after prong 124 is inserted through one of the plurality of holes 127. In this way, the excess length of belt 126 that is unused remains coupled against exterior surface 104 of band 102 so that it is out of the way and aesthetically pleasing.

Figure 11:
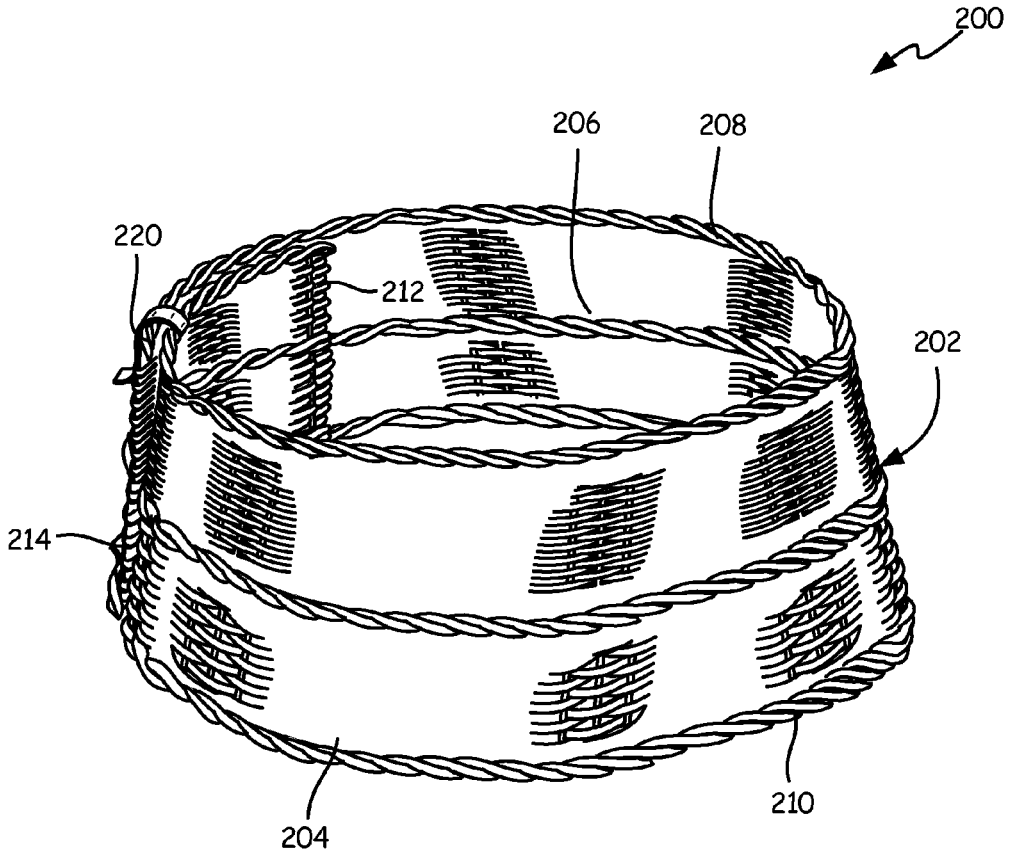
FIG. 11 is a perspective view of a tree collar as assembled according to yet another embodiment.
Figure 12:
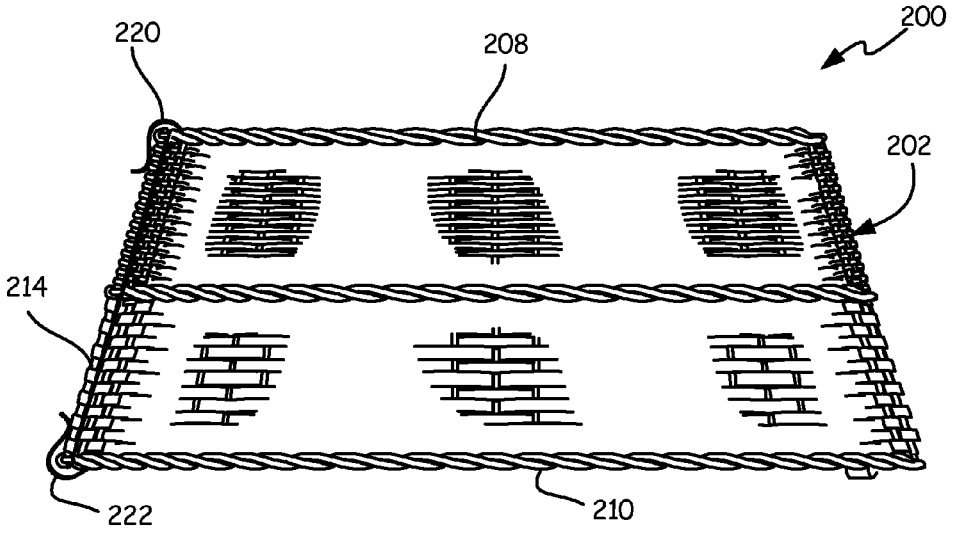
FIG. 12 is a front view of the assembled tree collar in FIG. 11.
Figure 13:
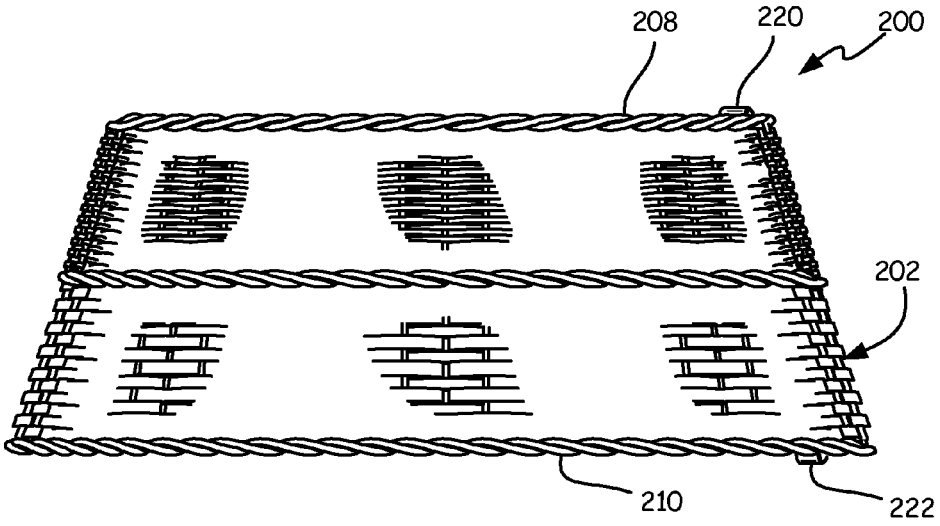
FIG. 13 is a back view of the assembled tree collar in FIG. 11.
Figure 14:
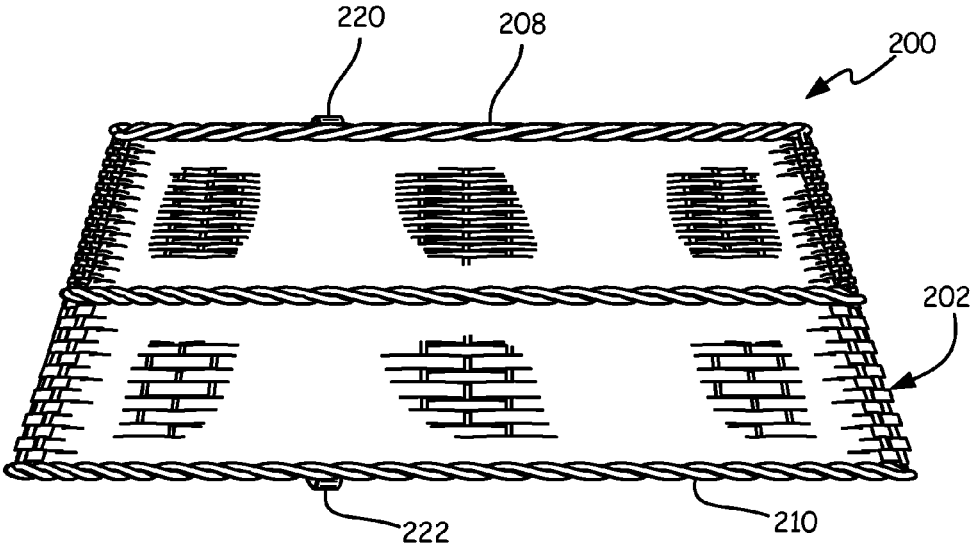
FIG. 14 is right side view of the assembled tree collar in FIG. 11.
Figure 15:
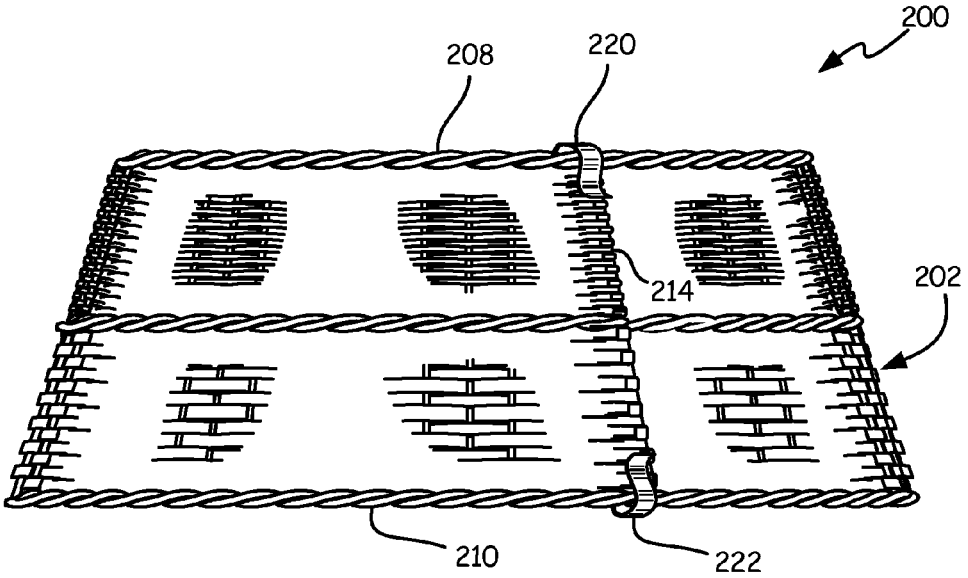
FIG. 15 is a left side view of the assembled tree collar in FIG. 11.
Figure 16:
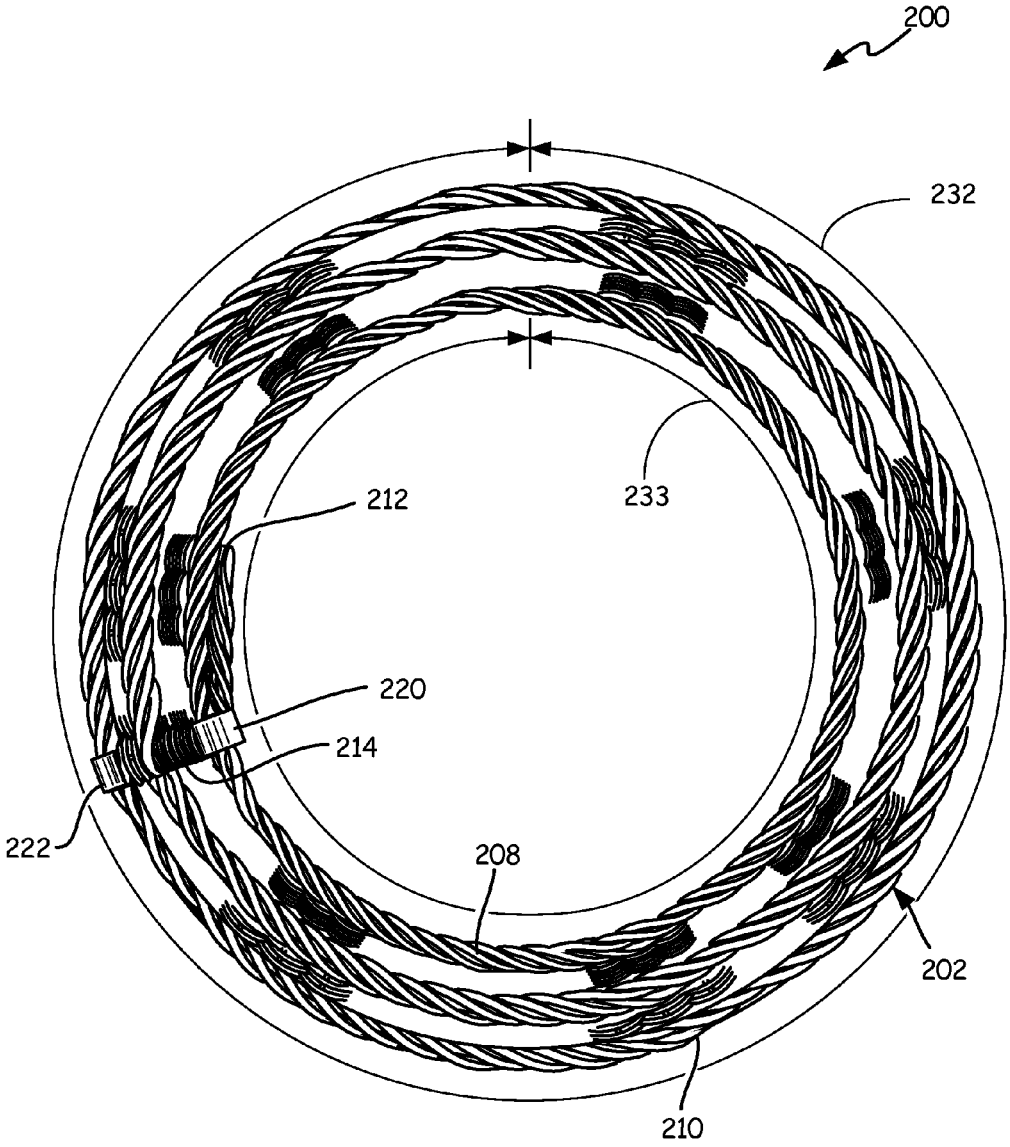
FIG. 16 is a top view of the assembled tree collar in FIG. 11.
Figure 17:
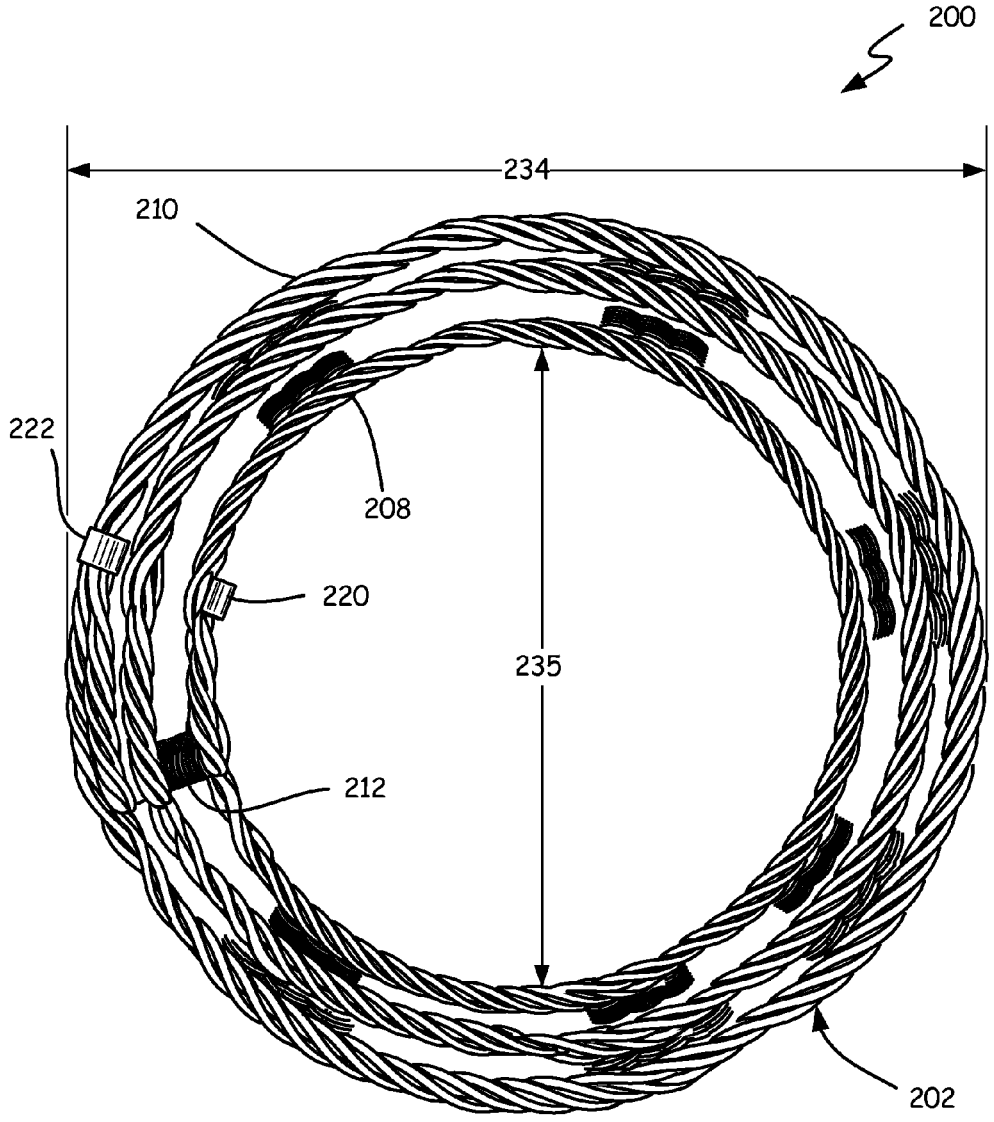
FIG. 17 is a bottom view of the assembled tree collar in FIG. 11.

FIG. 11 illustrates a perspective view of a tree collar 200 in an assembled state according to another embodiment. FIGS. 12-17 are orthogonal views of the assembled state of tree collar 200 in FIG. 11 including a front view, a back view, a right side view, a left side view, a top view and a bottom view, respectively. The fragmented depictions of weave pattern shown in the views in FIGS. 11-17 are understood to repeat or be continuous throughout.

Tree collar 200 includes a band or sleeve 202. In the embodiment illustrated in FIGS. 11-17, band or sleeve 202 is made of a wicker material and has an exterior or outer facing surface 204 and an interior or inner facing surface 206. Band or sleeve 202 also includes a top edge 208, a bottom edge 210, a first end 212 and a second end 214. Band or sleeve 202 tapers from top edge 208 to bottom edge 210 so that a length of top edge 208 is less than a length of bottom edge 210. Tree collar 200 further includes a first hook or clasp 220 and a second hook or clasp 222. First hook 220 and second hook 222 are separate components from band 202.

As assembled, tree collar 200 is annular and is formed into a frusto-conical shape so as to surround and hide a tree stand. First and second ends 212 and 214 overlap each other to provide an adjustable circumference 232 along bottom edge 210 and an adjustable circumference 233 along top edge 208 of band or sleeve 202. Overlapping ends 212 and 214 also provide an adjustable diameter 234 at bottom edge 210 and an adjustable diameter 235 at top edge 208 of band or sleeve 202. Because band or sleeve 202 tapers from top edge 208 to bottom edge 210, adjustable circumference 232 of bottom edge 210 of band or sleeve 202 is always greater than adjustable circumference 233 of top edge 208 of band or sleeve 202. In addition, adjustable diameter 234 as measured through the center of the circle defined by bottom edge 210 is always greater than adjustable diameter 235 as measured through the center of the circle defined by top edge 208.

As illustrated in FIGS. 11-17, first end 212 is positioned so as to ride on the interior surface 206 of band or sleeve 202 while second end 214 is positioned so as to ride on exterior surface 204 of band or sleeve 202. In other words, exterior surface 204 of band 202 at first end 212 is placed adjacent to interior surface 206 of band 202 at second end 214 to form the frusto-conical shape. However, it should be realized that first end 212 could be positioned so as to ride on exterior surface 204 and second end 214 could be positioned so as to ride on interior surface 206.

Figure 18:
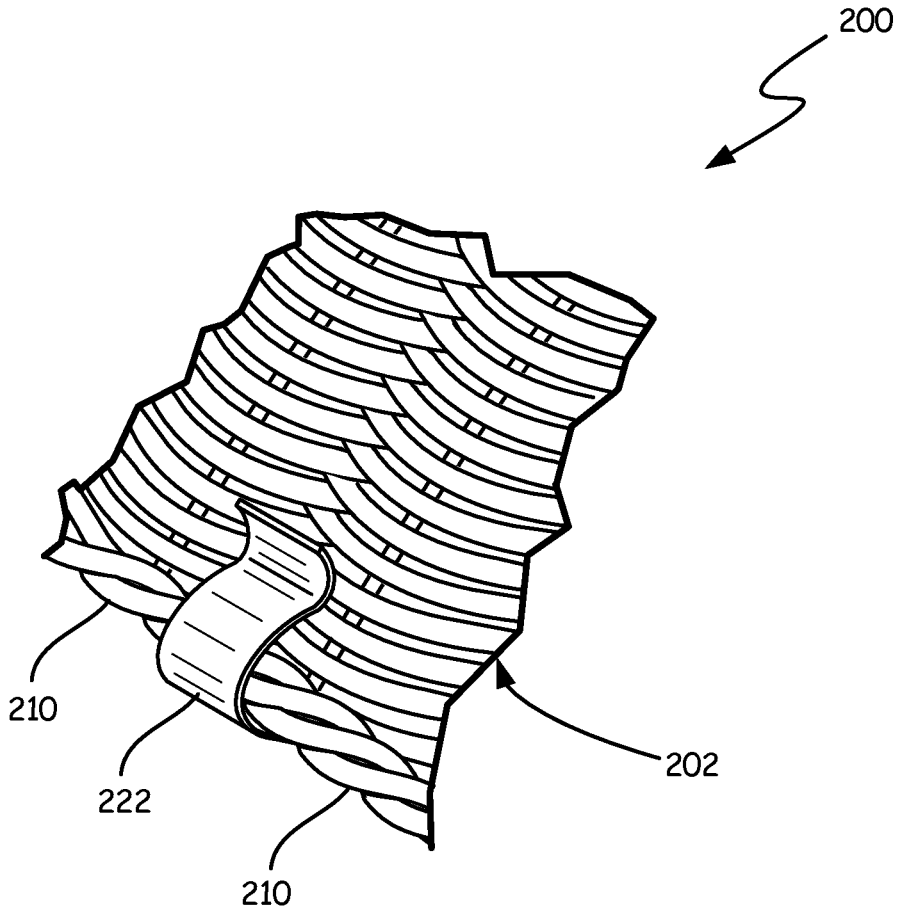
FIG. 18 is an enlarged perspective view of a second hook or clasp that attaches a portion of the bottom edge of the band or sleeve to a different portion of the bottom edge of the band or sleeve.

As illustrated in FIGS. 11-17 and when tree collar 200 is in the assembled state, first hook 220 attaches or secures a portion of top edge 208 of band 202 to a different portion of top edge 208 of band 202 and second hook 222 attaches or secures a portion of bottom edge 210 to a different portion of bottom edge 210. More specifically, first hook or clasp 220 secures the top edges 208 of two different portions of band or sleeve 202 and second hook or clasp 222 secures the bottom edges 210 of two different portions of band or sleeve 202. FIG. 18 illustrates an enlarged perspective view of second hook or clasp 222 of tree collar 200 that attaches or secures two different portions of bottom edge 210 together.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tree collar for hiding a tree stand, the tree collar comprising:

a metallic band having an inner facing surface, an outer facing surface, a top edge, a bottom edge, a first end and a second end, wherein a length of the metallic band at the top edge is less than a length of the metallic band at the bottom edge;

a first clasp formed integral with the metallic band and protruding from the top edge of the metallic band;

a second clasp formed integral with the metallic band and protruding from the bottom edge of the metallic band;

a prong that protrudes from the outer facing surface of the metallic band at a location that is spaced apart from the top edge and the bottom edge and spaced apart from the first end and the second end; and a belt having a fixed end coupled to the outer facing surface of the metallic band, a free end and a plurality of holes located between the fixed end and the free end, wherein the free end of the belt includes a permanent magnet;

wherein the first and second ends of the metallic band overlap each other to form the metallic band into a frusto-conical: shaped sleeve for surrounding the tree stand by inserting a portion of the top edge of the metallic band into the first clasp and inserting a portion of the bottom edge of the metallic band into the second clasp to hold and adjust a circumference of the sleeve; and wherein the prong is configured to be inserted through one of the plurality of holes in the belt and the permanent magnet of the free end of the belt is configured to magnetically couple the belt to the outer facing surface of the metallic band to secure the sleeve at a chosen circumference.

2. The tree collar of claim 1, wherein the fixed end of the belt is located in closer proximity to the second end of the band than the first end of the band.

3. The tree collar of claim 1, wherein the prong extends through a thickness of the band so as to also protrude from the inner facing surface of the band to provide structural integrity to the portion of the prong that protrudes from the outer facing surface.

* * * * *